United States Patent [19]

Shea et al.

[11] 4,454,798

[45] Jun. 19, 1984

[54] FOAM FILLED MUZZLE BLAST REDUCING DEVICE

[75] Inventors: John W. Shea, King George, Va.; Larry L. Pater, Zelienople, Pa.

[73] Assignee: The United States of America as represented by the Secretary of the Navy, Washington, D.C.

[21] Appl. No.: 352,448

[22] Filed: Feb. 25, 1982

[51] Int. Cl.[3] ..... F41F 17/12

[52] U.S. Cl. ..... 89/14 B; 89/14 D; 181/223

[58] Field of Search ..... 89/30, 31, 14 B, 14 C, 89/14 D; 181/223

[56] References Cited

U.S. PATENT DOCUMENTS

| | | | |
|---|---|---|---|
| 2,468,926 | 5/1949 | Garrett | 89/14 B |
| 4,334,591 | 6/1982 | Martin | 89/40 L |
| 4,392,412 | 7/1983 | Schmidt et al. | 89/14 D |

FOREIGN PATENT DOCUMENTS

| | | | |
|---|---|---|---|
| 6680 | of 1908 | United Kingdom | 89/14 D |

OTHER PUBLICATIONS

Reduction of 5"/54 Gun Blast Overpressure by Means of an Aqueous Foam-Filled Muzzle Device, Report NSWC TR 81-128, Shea et al., Aug. 1981.

Use of Aqueous Foam to Mitigate Demolitions Noise, Report CERL-TR-N-112, Richard Raspet, Dec. 1981.

*Primary Examiner*—Stephen C. Bentley

*Attorney, Agent, or Firm*—Robert F. Beers; Kenneth E. Walden; John C. LaPrade

[57] ABSTRACT

A device for reducing the muzzle blast and flash from large caliber guns is disclosed. A container having a plurality of internal chambers and baffel plates filled with an aqueous foam is mounted to the muzzle of the gun barrel. The foam and chambers co-operate to substantially suppress muzzle blast noise and completely suppress muzzle flash.

3 Claims, 4 Drawing Figures

SOUND LEVEL REDUCTIONS vs. FOAM EXPANSION RATIO

FOAM FILLED MUZZLE BLAST REDUCING DEVICE

BACKGROUND OF THE INVENTION

This invention relates to noise silencing devices for guns. More particularly the invention relates to a device for supressing the noise blast and flash from large caliber guns. In still greater particularily the invention relates to supression of noise blast and flash from large caliber guns using a contained foam.

It is well known that the noise from the operation of large caliber guns has long been a source of environmental concern. In particular, training exercises and gun testing facilities can create substantial amounts of blast noise that effect surrounding personnel and the public located in the area. The closing, relocating or placing operational restrictions on such exercises and facilities severly limits the effectiveness of fleet operations. There is therefore a keen interest in finding a way to reduce muzzle blast noise without imposing restrictions on training and testing operations.

Heretofore gun silencer technology has been limited to small and medium caliber guns. These devices in general utilize baffel chambers and orifices to dissipate blast energy. The application of conventional small caliber silencing technology is not applicable to large caliber guns because, to do so, would require devices of enormous size and weight. In fact it may be said that to silence large caliber guns, such as a 5" caliber gun, using small caliber techniques is totally impractical.

Reduction of blast noise of the magnitude associated with large guns has been done with unconfined foam techniques. These techniques have been limited to large open air explosive charges.

It can be appreciated that there exists a need for a device that can significantly reduce the noise associated with large caliber guns.

SUMMARY OF THE INVENTION

It is an object of the invention to provide for a device that significantly reduces the noise from large caliber guns created by muzzle blast wave. It is another object of the invention to supress visible flash from the muzzle of guns.

The objects of the invention are achieved and the shortcomings of the prior art are overcome by attaching a device having a chamber filled with an aqueous foam, or a foam of the type created by chemical reaction, to the muzzle end of the gun barrel. The device may be a single foam filled chamber or a plurality of foam filled chambers formed by internal baffels. As the projectile exits the barrel of the gun, the chamber and foam cooperate to remove enery from the blast wave that exits the barrel immediately after the projectile.

Other objects and many attendant advantages will be appreciated as the subject invention becomes better understood by reference to the detailed description, when considered in conjunction with the accompanying drawings.

DETAILED DESCRIPTION OF THE PREFERRED EMBODIMENT

Figure 1:
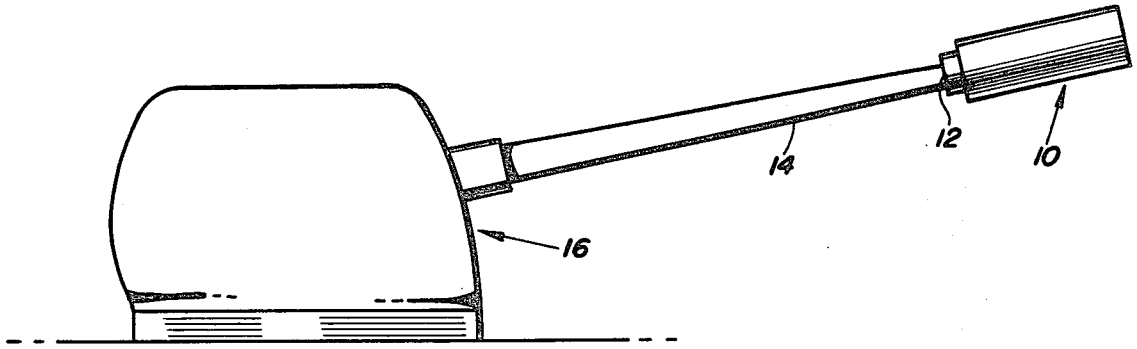
FIG. 1 is a pictorial representation of the device in use mounted to the muzzle end of a gun barrel.
Figure 2:
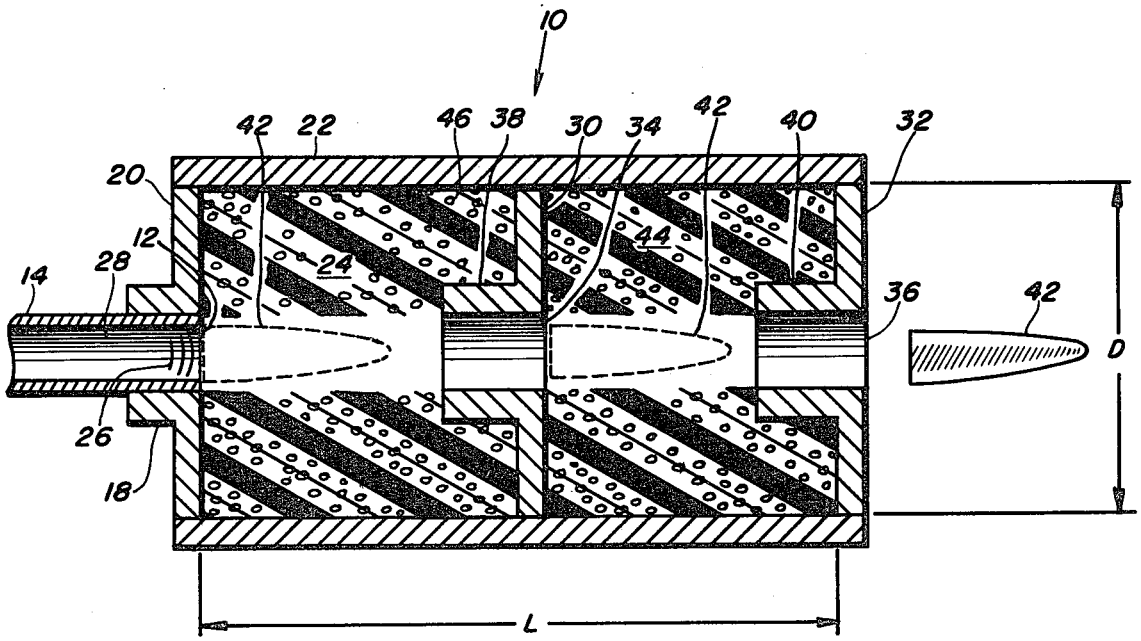
FIG. 2 is a longitudinal cross sectional view of the preferred embodiment of the invention.

Shown in FIG. 1, and as best shown in FIG. 2, is a muzzle blast reducing container 10 secured to the muzzle end 12 of the barrel 14 of gun 16. Blast reducing container 10 is secured to barrel 14 by clamping the flange 18 thereto. Other means of securing the device may be used and will readily come to the mind of one skilled in mechanical engineering. Container 10 includes an end plate 20 to which flange 18 is attached or otherwise made a part. End plate 20 is attached to a cylindrical container wall 22, preferably by welding, since it is contemplated to be permanently attached and capable to withstand the large forces developed within chamber 24 when the blast wave 26 leaves the bore of barrel 14. In the embodiment shown in FIG. 1, there is an internal baffel plate 30 secured to container wall 22 preferably at the center of the wall.

Figure 3:
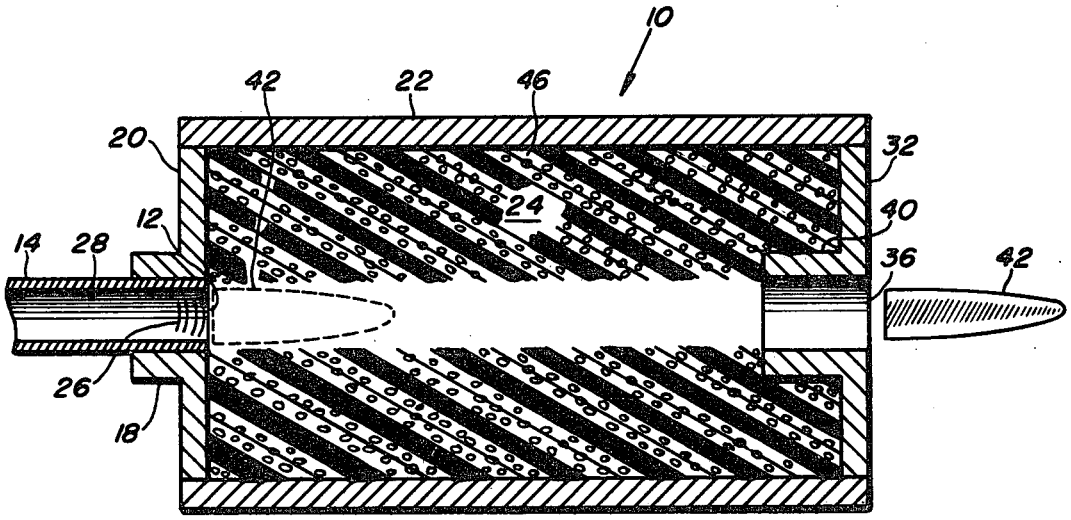
FIG. 3 is a longitudinal cross sectional view of an alternative embodiment.

Baffel plate 30 may be welded to wall 22 or made removable if desired to accommodate the alternative configuration shown in FIG. 3. Secured to the end of container 22, opposite muzzle end 12, is another baffel plate 32 which acts to close container wall 22 and form the closed container 10. Baffel plates 30, 32 have holes 34, 36 respectively located coaxially to bore 28 forming an opening through container 22. The diameters of holes 34, 36 are sufficient to allow the projectile 42 to pass through. Baffel plates 30, 32 also have circular projections 38, 40 respectively, also located coaxially with gun barrel 28. Projections 38, 40 extend approximately one caliber in length into chambers 24, 44 providing additional blast wave attenuation. Baffel plate 30 divides container 10 into two chambers 24, 44 which are filled to at least 90% of their capacity with a foam 46 to be more fully described hereinafter.

It is to be understood that the invention is not to be considered limited to a maximum of two chambers of equal volume, but rather a container having more chambers is contemplated to be within the scope of the invention. The two chamber configuration was chosen and described herein as representative, and because it has demonstrated substantial noise and flash reduction on the particular gun used to evaluate this invention.

It has been determined that for the application to which this device is applied, a five inch caliber gun, a case length L to diameter D ratio of 10 calibers to 5 calibers was desirable. This ratio was acceptable from a handling and installation standpoint, and yielded a volume sufficient to hold enough foam to give substantial noise reduction. Other L/D ratios, for a given application, depend on the foam expansion ratio and ease of handling and installing. The L/D ratio may vary, provided the volume of the container, as experimentally determined, is sufficient to give substantial reductions in noise.

Figure 4:
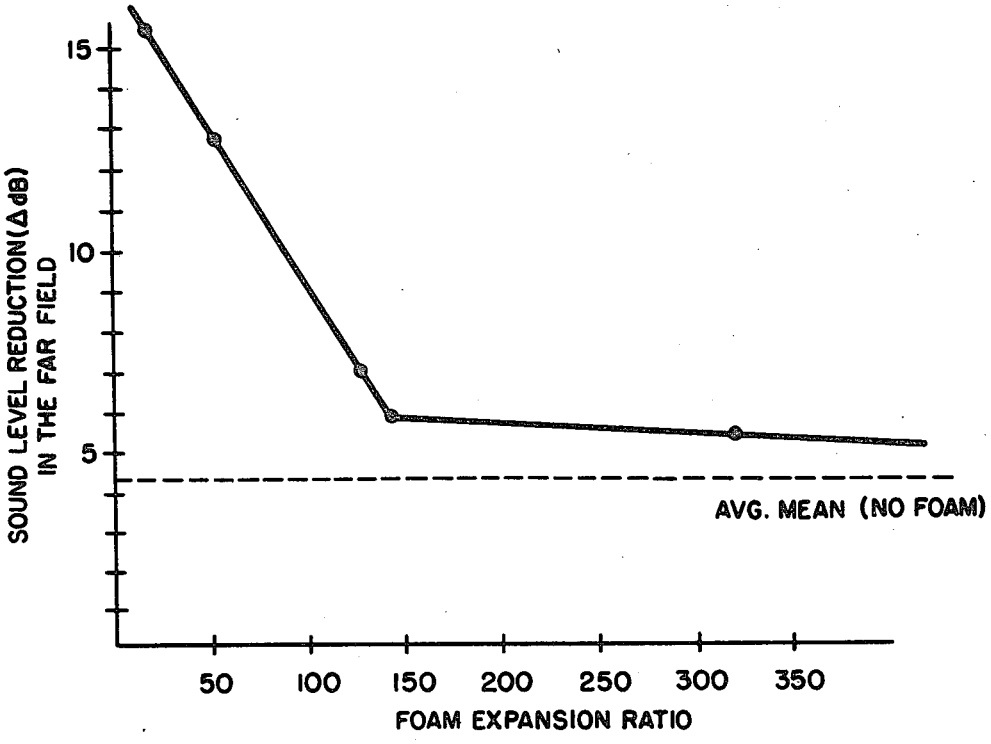
FIG. 4 is a graphical representation of the effect of foam expansion ratio on the reduction of noise from the gun.

The foam used to fill chamber 24, 44 is a synthetic based film forming aqueous foam, that is, generated by agitating water, and a synthetic based foaming agent. It is desirable that the foam have an expansion ratio in the range of 10:1 to 140:1. Forms having an expansion ratio within this range exhibit blast suppression characteristics. FIG. 4 shows the effect of foam expansion ratio on reduction of noise, and is typical for all foams. Expansion ratio is defined as the ratio of the volume of the expanded foam to the volume of the original liquid constituents. In addition to having an acceptable density, the foam must be physically stable as measured by, what is known in the field of foams, as quarter life. Quarter life is the time interval for 25% of the liquid portion of the foam to drain from the foam. A foam having a high quarter life is considered more stable than one having a low quarter life. A quarter life of 2–5 minutes is desired so that sufficient time is available to fill the container 10 and fire the gun.

Additionally, the foam must be chemically stable within the container and not react with powder residue or oil on the interior of the container walls and baffels.

It has been found that purely synthetic based foams known as film forming foams have these required characteristics and are acceptable for use as disclosed herein. It is known in the field of foams, and these film forming foams may be identified, as those foams made by adding small percentage amounts of fluro surfactants, such as a sodium salt of perfluro octanate acid, to a high expansion foam. One film forming foam available and used as disclosed is AQUAFOAM AFFF made by Rockwood Systems Corporation.

The foregoing description, while sufficient for one skilled in the field of mechanical engineering and gun silencers to make and use the invention, is better understood when considered with the following preferred mode of operation.

PREFERRED MODE OF OPERATION

In operation the container 10 is secured to the barrel 14 of gun 16 as previously mentioned. To prevent foam from entering bore 28 during filling of the chambers 24, 44, a cork-like stopper, not shown, is placed within the bore of the barrel from the end of the barrel opposite to the container. Commercially available foam generation equipment, not shown, is used to generate foam 46 and fill chambers 24, 44. When the chambers are filled, the stopper is withdrawn, projectile 42 loaded into the gun and fired. Projectile 42 passes through the foam and exits the device with only minimal effect on its velocity. Blast wave 26 trails projectile 42 and, without the benefit of the device, would travel far down field being heard as a loud noise. The foam, chambers and baffel plates co-operate to absorb and dissipate the accoustic blast wave 28 so that it is substantially reduced when it exits at hole 36.

Additionally, the flash normally associated with firing of the gun has been found to be completely eliminated. Foam 46 is expelled from the device behind projectile 42 in the form of vapor, leaving no liquid residue. The device can then be refilled for subsequent use.

Other embodiments and modifications of the invention will readily come to the mind of one skilled in the art having the benefit of the teachings presented in the foregoing description and drawings. It is to be understood that this invention is not limited thereto and that said modifications and embodiments are to be included within the scope of the appended claims.

What is claimed is:

1. A device for reducing the blast and flash from the muzzle of a gun barrel as a projectile is discharged comprising:

a foam of the type having at least one portion thereof existing in a thin film liquid form when in the foam state, and where the foam consists of water and a synthetic foaming agent and where the foam has an expansion ratio in the range of 10 to 1 to 140 to 1, with, a hollow container defining a chamber filled with said liquid foam said container including an inlet hole and an outlet hole coaxially aligned with the chamber to allow the projectile to pass through said container and foam, whereby the blast and flash associated with the discharge of the projectile from the barrel are substantially reduced.

2. A device for reducing the blast and flash from the muzzle of a gun as a projectile is discharged comprising:

a container defining at least one chamber therein and having an opening therethrough to allow passage of the projectile through said container said chamber filled with a liquid thin film forming foam, and where the foam consists of water and a synthetic foaming agent and where the foam has an expansion ratio in the range of 10 to 1 to 140 to 1 whereby the projectile passes through said liquid foam and the blast and flash associated with the discharge of the projectile from the barrel are substantially reduced.

3. A device for reducing the blast and flash from the muzzle of a gun barrel as a projectile is discharged comprising:

a container having baffel means mounted within said container for creating a plurality of chambers, said container and baffel means having aligned apertures forming a passage through said container and chambers to allow passage of the projectile therethrough, each chamber filled with a synthetic based aqueous film forming foam, and where the foam consists of water and a synthetic foaming agent and where the foam has an expansion ratio in the range of 10 to 1 to 140 to 1 whereby the projectile passes through the foam and the blast and flash associated with the discharge of the projectile from the barrel are substantially reduced.

* * * * *